US009717641B2

(12) United States Patent
Ky

(10) Patent No.: US 9,717,641 B2
(45) Date of Patent: Aug. 1, 2017

(54) PORTABLE LEG DEEP VEIN MASSAGER AND PROPULSOR

(71) Applicant: Albert Ky, Alameda, CA (US)

(72) Inventor: Albert Ky, Alameda, CA (US)

( * ) Notice: Subject to any disclaimer, the term of this patent is extended or adjusted under 35 U.S.C. 154(b) by 0 days.

(21) Appl. No.: 14/622,693

(22) Filed: Feb. 13, 2015

(65) Prior Publication Data

US 2016/0235612 A1 Aug. 18, 2016

(51) Int. Cl.
*A61H 7/00* (2006.01)
*A61H 9/00* (2006.01)

(52) U.S. Cl.
CPC ..... *A61H 7/001* (2013.01); *A61H 9/0078* (2013.01); *A61H 2201/1215* (2013.01); *A61H 2201/1238* (2013.01); *A61H 2201/149* (2013.01); *A61H 2201/1481* (2013.01); *A61H 2201/164* (2013.01); *A61H 2201/165* (2013.01); *A61H 2201/5002* (2013.01); *A61H 2201/5071* (2013.01); *A61H 2209/00* (2013.01)

(58) Field of Classification Search
CPC .. A61H 9/0078–9/0092; A61H 9/0007; A61H 2011/005; A61H 23/00; A61H 23/006; A61H 23/02; A61H 2023/002; A61H 7/001; A61H 2209/00
See application file for complete search history.

(56) References Cited

U.S. PATENT DOCUMENTS

| | | | | |
|---|---|---|---|---|
| 6,290,662 | B1 * | 9/2001 | Morris | A61H 9/0078 601/149 |
| 7,618,384 | B2 * | 11/2009 | Nardi | A61B 5/6828 601/101 |
| 8,100,842 | B2 * | 1/2012 | Rousso | A61H 9/0078 601/148 |
| 2007/0055188 | A1 * | 3/2007 | Avni | A61F 13/041 601/151 |
| 2008/0039752 | A1 * | 2/2008 | Rousso | A61H 7/001 601/134 |
| 2009/0118651 | A1 * | 5/2009 | Rousso | A61H 11/00 601/134 |

* cited by examiner

*Primary Examiner* — Valerie L Woodward
(74) *Attorney, Agent, or Firm* — Walt Froloff

(57) ABSTRACT

A portable deep vein leg massager apparatus with harness attaching to a human lower leg having a segmented calf surface staged assemblies compressing and decompressing the calf muscle directionally toward the shin. The segmented staged electromechanical assemblies act synchronously to compel deep vein blood vessels to push blood from the ankle towards the heart.

8 Claims, 17 Drawing Sheets

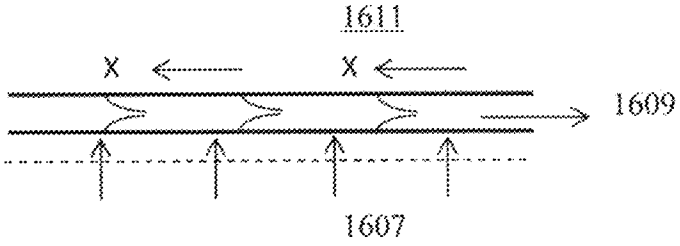
Fig. 16
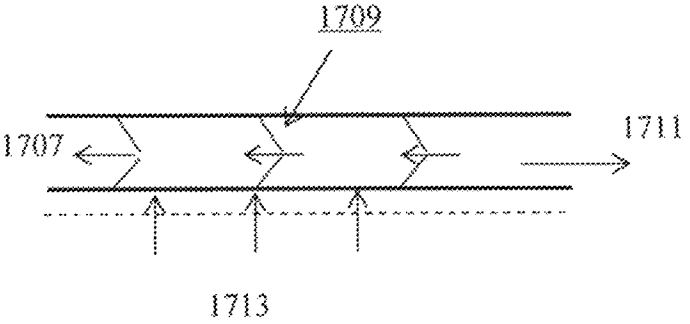
Fig. 17
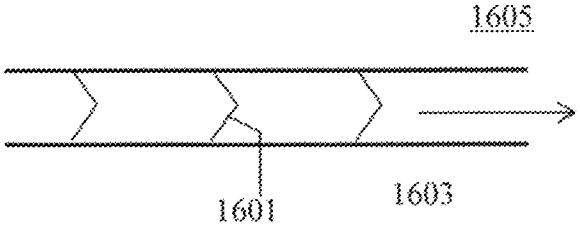
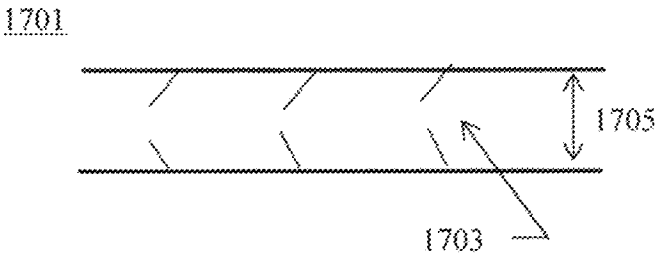

PORTABLE LEG DEEP VEIN MASSAGER AND PROPULSOR

BACKGROUND

Field of the Invention

The present invention generally relates to portable massagers and propulsor specifically to push stagnating blood in the leg deep vein forward.

Background

The area of physical massage contains a large diversity of products. Most products for leg massage in particular are add-ons included in massage chairs.

Physical problems arise from standing on one's feet for extended periods of time without rest. In some cases an individual's legs could develop some degree of swelling, due to blood pooling. In some of those varicose vein patients, the cause could be either a genetic factor, or a "long standing or long sitting" life style, or a genetic factor precipitated by the "long standing/long sitting" life style. Whatever the cause, treating the blood pooling problem can at least delay the appearance of the varicose veins and other problems. The leg swelling or the varicose vein, due to the blood flow resistance in the feet and lower leg inhibiting blood flow in the normal way to overcome gravity. Blood returns to the heart via the leg deep veins, the normal mode, generally occurs from pumping the blood to the heart with each vein valve compression produced by the calf muscle contraction. In the absence of such contractions, there is a need for some kind of device to produce the compression on the leg deep veins. This is not a simple requirement as the deep veins are somewhat protected by the tibia bone on the under side and muscles on the other.

Achilles tendonitis and other leg ailments have partial remedies using massage of the calf muscles. Some teach resting while moving Achilles tendon side calf over a rolling pin for a speeder recovery.

There are devices on the market, typically known as "leg muscle massager", which function to massage the arm and leg muscle respectively. Some come with a easy chair and some are stand alone but require a stationary situation. These have a limited effect on the leg deep veins as shown in FIG. 1 and FIG. 2 for the reason that the veins are protected over a range along the leg and air cuffs squeeze on leg total circumference acting massage on the veins from all directions simultaneously and have some effect in leaving the blood in the veins trapped locally and not optimal to deep vein blood flow. In some cases the current leg massager offerings are a "stretched out" version of the arm blood pressure cuff pressurizing kit, which uses an entire leg or arm appendage circumference air cuff to produce compression over a substantial length of the leg simultaneously, cycling over the entire length and circumferentially around the leg. Compressing the entire appendage from all directions over a length of leg does not efficiently pump blood through the deep leg veins, because the leg deep vein is protected near the calf center and circumferential forces act to compress and harden surrounding muscle instead of allowing massaging forces to reach the leg deep veins.

Other ailments like varicose vein and Achilles tendon can also be relieved by deep vein leg calf massage. During trips where sitting for lengthy periods is mandatory, leg massage is instrumental in reduction of chances of relative low circulating blood volume, due to impeded blood flow causing pooling in the legs. What are needed are portable deep vein leg/calf massage devices.

SUMMARY

The present invention discloses a portable deep vein leg massager and propulsor equipment with harness attaching to a human leg having a base holder plate affixed to an inner cartridge fitted for supporting independent compression-decompression mechanical assemblies in stages, base holder plate coupled to harness straps and positioned by the harness to the leg calf opposite the shin bone. Each stage independent mechanical assemblies have mechanical mechanism for applying a compressing-decompressing force to a calf conforming surface area, stages with calf surface area plate-like segments pushed and pulled by each stage mechanical mechanisms supported by the inner cartridge plate. At least two harness straps couple a shin bone positioned Tibia-straddling plate-like component opposite a more-or-less flattened calf length-wise conforming surface base plate. Power in the form of batteries are affixed to the shin bone plate for powering the mechanical mechanism to compress and decompress each stage segmented calf surface component. A variable period timer switch is electrically coupled to battery power for energizing and de-energizing the mechanical mechanism assembly stages, and controls for compressing and decompressing the mechanical assembly stages cycling up and down the leg calf in concert to compel deep vein blood toward the heart.

BRIEF DESCRIPTION OF DRAWINGS

Specific embodiments of the invention will be described in detail with reference to the following figures.

FIG. 16 displays normal blood flow in deep veins describing an aspect of the present invention.

FIG. 17 displays overly distended deep vein blood flow in deep veins describing an aspect of the present invention.

DETAILED DESCRIPTION

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Objects and Advantages

The present invention discloses a portable deep vein massage and propulsor apparatus. Accordingly, it is an object of the present invention to use light-weight components and applicable mechanisms to enhance massager portability and functionality while reducing massager power consumption.

It is another object of the invention to engage the natural deep vein system to compel blood through the lower body circulatory network in a tuned fashion, synchronizing with the natural one-way valvule system found in the leg veins.

It is yet another object of the invention to aid in compelling deep vein flow through without working cross-purposes by simultaneous 360 degree leg calf circumference compressions.

It is another object of the invention to provide travelers in confined spaces for long distances a way to alleviate chances of relative loss of circulating blood flow, through leg massage.

It is yet another object of the invention to provide workers who must stand for periods of time to have their legs massaged while standing and without tether to a power cord and outlet.

Figure 1:
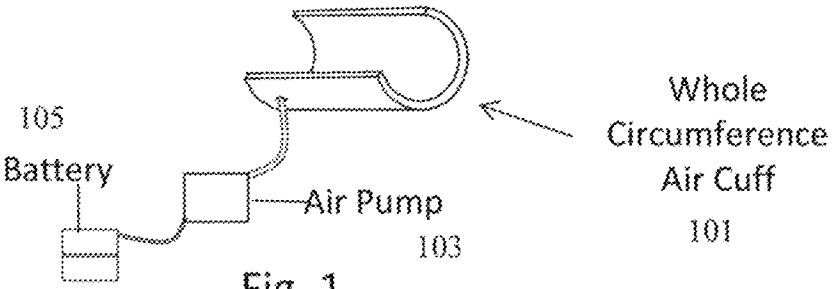
FIG. 1 illustrates a typical arm blood pressure kit.
Figure 2:
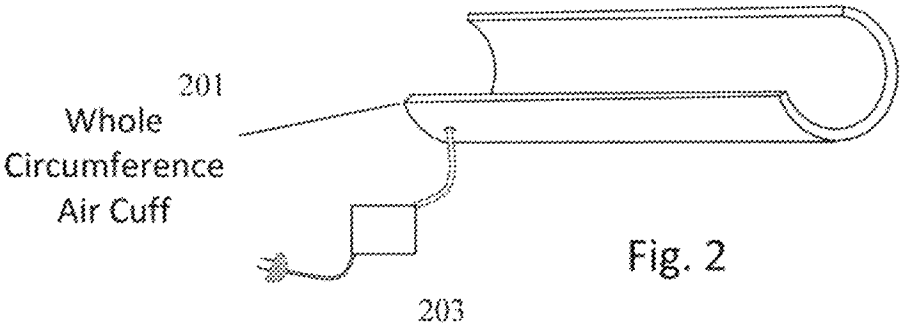
Fig. 2 Prior Art
FIG. 2 illustrates a typical leg muscle massager apparatus

Embodiments of the invention are based on overcoming deficiencies in the present market offerings for lower leg deep vein massage FIG. 1 illustrates a typical arm blood pressure kit complete with a whole leg circumference air cuff 101, air pump 103 and power 105. FIG. 2 illustrates a typical leg muscle massager apparatus, complete with near-entire circumference air cuff 201 with powered air pump 203.

Figure 3:
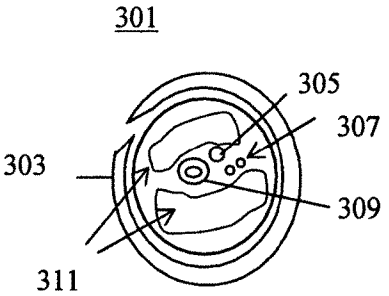
FIG. 3 illustrates a Cross Section of the human arm in describing an aspect of the present invention.

FIG. 3 illustrates a Cross Section of the human arm in describing an aspect of the present invention. The air cuff 303 is shown directly compressing the arm artery and veins surrounded by the arm muscles 311 which concentrically surround the humorous 309 and arteries 305 and veins 307 in the arm.

Figure 4:
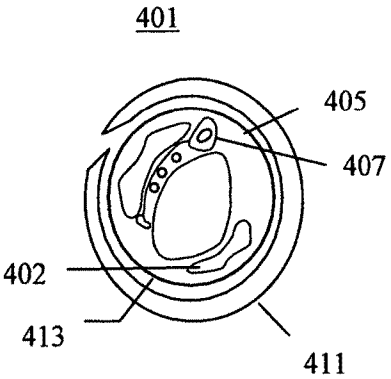
FIG. 4 illustrates a Cross Section of the human calf in describing an aspect of the present invention.

FIG. 4 illustrates a Cross Section of the human calf 401 in describing an aspect of the present invention. Here the air cuff 411 rests on and overlays the skin 405 with air between 413, the skin 405 with the deep vein protecting Tibia 407, calf muscles 402, and leg deep veins and artery.

Figure 5:
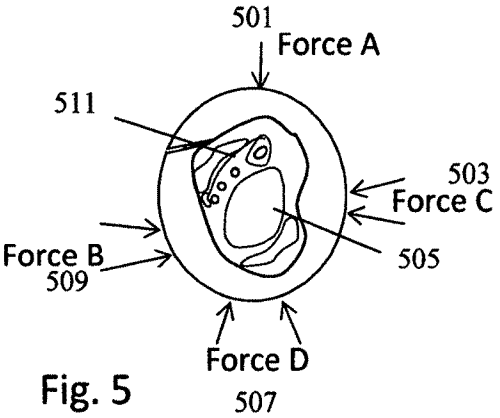
Fig. 5 Prior Art
FIG. 5 illustrates a Cross Section of the human calf in describing an aspect of the present invention.

FIG. 5 illustrates a Cross Section of the human calf in describing an aspect of the present invention. The typical air cuffs in FIG. 3 and FIG. 4 apply forces simultaneously along the circumference of the leg as shown in FIG. 5 in force A 501, force B 509, force C 503 and force D 507 periphery of the leg skin. This in turn pressures the muscle 505 and Interosseous Membrane 511 surrounding the inner deep veins. These are the current results of actions on the arm and leg blood pressure kits and muscle massagers. Unlike the air cuff of the arm blood pressure kit FIG. 3 which can easily compress the arm artery and veins because they lie just underneath the skin, the "leg muscle massager" FIG. 4, on the other hand, can't produce as much compression on the leg deep veins due to the following two reasons: 1) the leg deep veins lie deep inside the calf, behind the bones and muscles and 2) the entire circumference air cuff produces forces 501 503 507 and 509 which interfere or work counter purposes, constraining blood flow locally. Moreover specifically, force A 501 cannot effectively reach the leg deep veins, because it is substantially impeded by the interosseus membrane and bone structures.

When a force B 509 and force C 503 come from opposite directions, the Soleus muscle 505 is compressed into more compacted, harder mass, making it more resistant to the advancement of force D 507 which cannot then reach the leg deep veins for massaging. This demonstrates the ineffectiveness of the leg cuff massage method.

Figure 6:
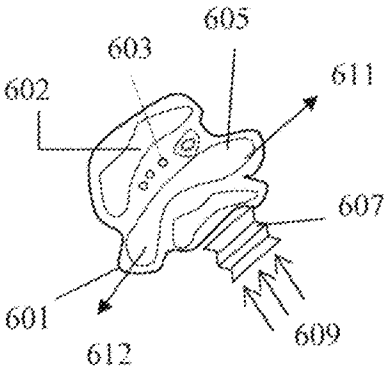
FIG. 6 illustrates flattened muscle under compression in describing an aspect of the present invention.

FIG. 6 illustrates flattened muscle under compression in describing an aspect of the present invention. Removing the Forces A,B &C FIG. 5 501 509 503 respectively will enhance any action of Force D 507. Thus by limiting uniform compression on the calf in favor of specific pressure on a segment of the circumference at force D FIG. 5 of the calf opposite the bone structure, massage on the leg deep vein is enhanced and through a reduction of force applied by the asymmetry of force application. As shown in FIG. 6 segmented or area compression 609 is applied to air bellow 607 compressor which compresses the muscle 601 which then flattens and expands laterally 611 612 and allows compression to propagate through the muscle 601 to the deep veins. The flattening of the muscle 605 compresses the leg deep veins 603 compelling blood through the vein on its way to the heart. This shows how the segmented area compression from the muscle 605 flattened face effectively massages the muscle 605 as well as the direcely compresses the deep veins 603 with a small fraction of the pressure 609 of a full leg circumference cuff applied pressure. This great reduction in pressure required for a more effective massage makes a smaller and portable massage unit possible and practical as the massager calf segment forces 609 are applied opposite to the shin 602 side and have no counter purpose forces applied circumferentially.

Figure 7:
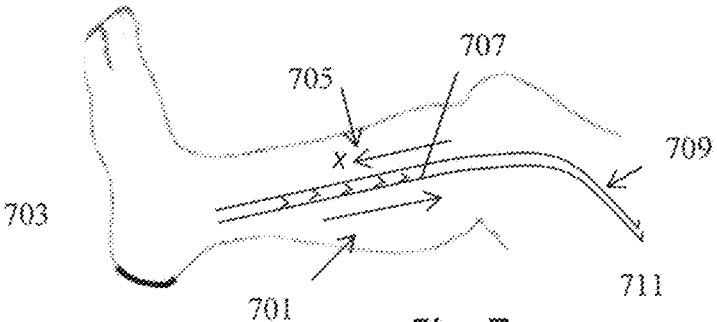
FIG. 7 illustrates leg deep vein massager blood flow in describing an aspect of the present invention.

FIG. 7 illustrates leg deep vein massager blood flow in describing an aspect of the present invention. Compression from the outside forces, compels blood flow 701 inside the leg deep veins 709 has to flow to the heart, downstream 711, because the flow to the upstream 703 direction, backflow 705, is blocked by those one-way-valves or leaflet valves 707 inside the veins.

Figure 8:
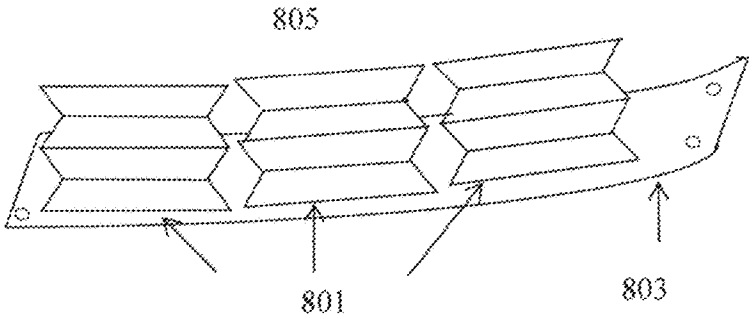
FIG. 8 displays the air bellow banks in an aspect of the present invention.

FIG. 8 displays the air bellow banks 805 in an aspect of the present invention. The three serial inline air bellows 801 are coupled to an aluminum cartridge plate 803, could be plastic or composite or other rigid or semi-rigid material, which is slightly contoured to fit snug to the calf of the leg at the segment covering local regions on the calf. Tubing puts the bellows in pneumatic communication to the air pump on the shin plate and it runs along the calf side of the cartridge plate 803 with the inflating system. Here, an array of three more or less rectangular shaped air bellows are shown, forming a segmented massager length of the leg calf. The bellows are pumped using a portable power source, here by a 12 V battery air pump.

Figure 9:
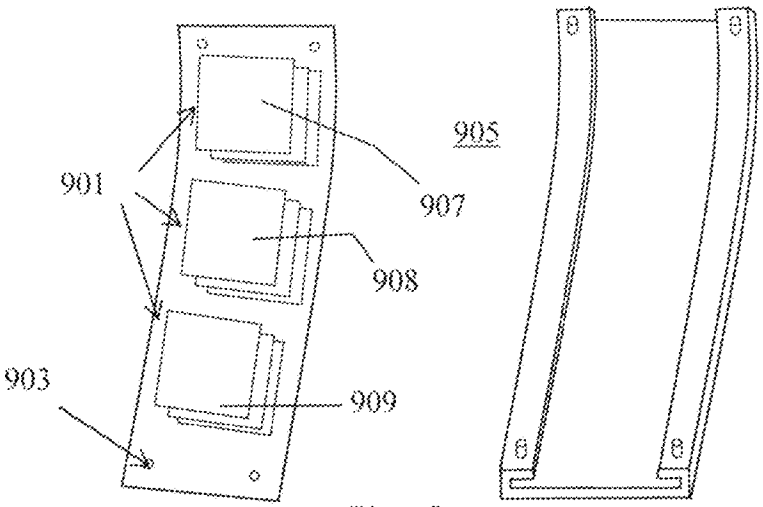
FIG. 9 shows the leg deep vein massager air bellow cartridge plate and cartridge base plate in an aspect of the present invention.

FIG. 9 shows the leg deep vein massager top view with air bellow 901 cartridge plate with fastener holes 903 and base plate 905 in an aspect of the present invention. The air bellows 901 are in stages supporting a series of segmented leg calf region plates 907 908 909 which are independently synchronously operated to provide a propulsive flow to the deep calf veins and muscle over specific areas. The calf surface adjacent plates 907 908 909 operate over very local segmented regions so as not to expend energy on circumferential regions of the calf which are not optimal operating on peripheral leg matter not effective in compressing-decompressing the calf deep veins.

Figure 10:
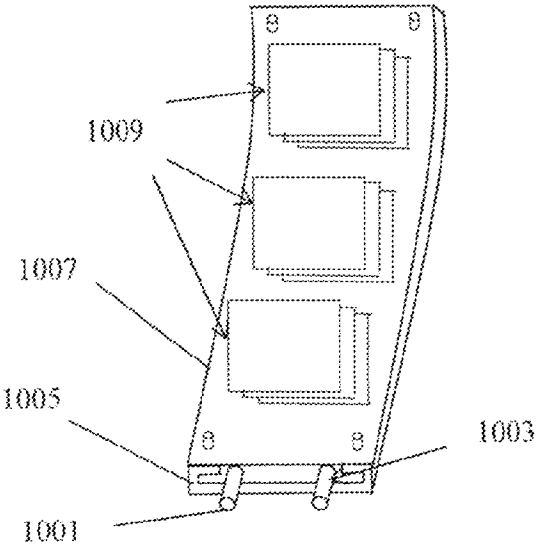
FIG. 10 shows the leg deep vein massager and propulsor air bellow cartridge plate and base plate assembly in an aspect of the present invention.

FIG. 10 shows the leg deep vein massager air bellow 1009 cartridge plate 1007 and base plate 1005 housing a mechanical compression-decompression assembly in an aspect of the present invention. Pneumatic tubing for supply and removal air for the bellow 1009 volumes with inflow 1001 and outflow 1003. On the inflow the tubing or conduit are in communication with the bellow inflow outlet and on the discharge side timed or pressure default valves regulate the outflow for bellows deflation. The tubing is contained in the base holder plate which has a calf longitudinal contour surface. The base plate may be made of a light weight metal, plastic, composite, rubber or other materials which are semi-rigid light and flexible in planar contour shapes and are made to house the cartridge with mechanical compression-decompression assembly.

Figure 11:
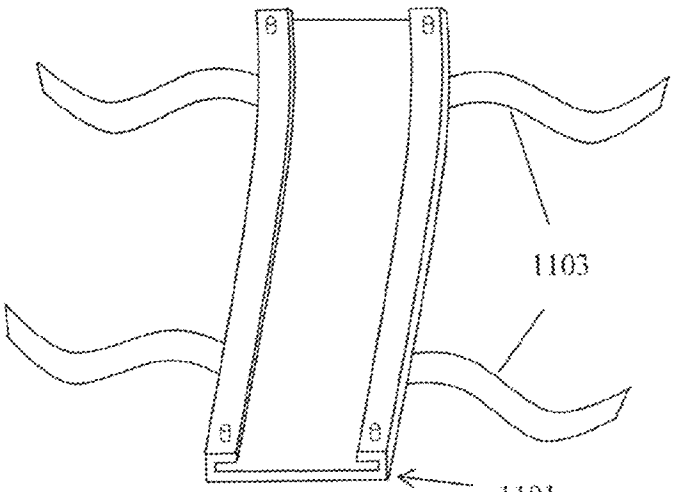
FIG. 11 shows the leg deep vein massager base plate 1101 and attaching fasteners 1103 leg harness in an aspect of the present invention.

FIG. 11 shows the leg deep vein massager and propulsor base plate 1101 and attaching fasteners 1103 leg harness in an aspect of the present invention. The attaching fasteners 1103 can be tie straps and loops, hook and loop straps, and most any other attaching methods which couple the housing base plate 1101 with the same leg opposing side of the tibia plate stabilizer. The base plate 1101, slide fitting the cartridge plate 1007 assembly, is coupled across the leg opposite side to bent straddling shin or tibia plate 1209 in some embodiments with hook and loop straps at the upper end and the lower end of the base plate 1101.

Figure 12:
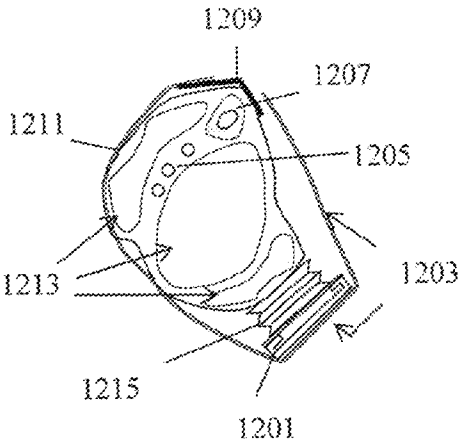
FIG. 12 shows a cross-section view of a leg deep vein massager base plate air bellows assembly attached to a shin plate in an aspect of the present invention.

FIG. 12 shows a cross-section view of a leg deep vein massager base plate 1201 and air bellows 1215 assembly straps 1203 1211 coupled to a Tibia plate 1209 in an aspect of the present invention. The massager leg harness includes an angular Tibia bone plate 1209 which rests on the leg skin covering the Tibia bone 1207 which somewhat shields the leg deep veins 1205. The harness fastener straps 1211 are fastened and tightly coupled from the tibia plate 1209 around the leg and attached to the base plate 1201 from one side and from the base plate 1203 around the tibia bone 1207 to the Tibia plate 1209 and from the other side of the Tibia plate 1209 to 1211 the other side of the Base plate 1203.

Figure 13:
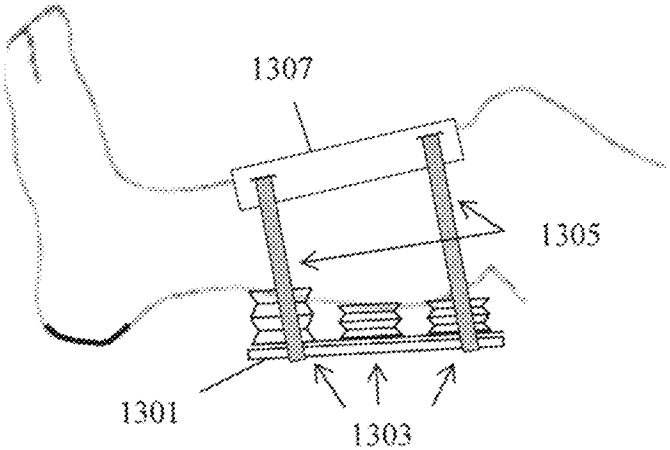
FIG. 13 displays a shin plate coupled to the air-bellows assembly of a leg deep vein massager in an aspect of the present invention.

FIG. 13 displays a lateral view of the massage harness with Tibia or shin plate coupled to the air-bellows assembly and base plate of a leg deep vein massager in an aspect of the present invention. In an embodiment of the invention the plate coupling straps 1305 slip through Tibia plate 1307 slots continuing around the leg to the opposite side of the bellow assembly base plate 1301.

Figure 14:
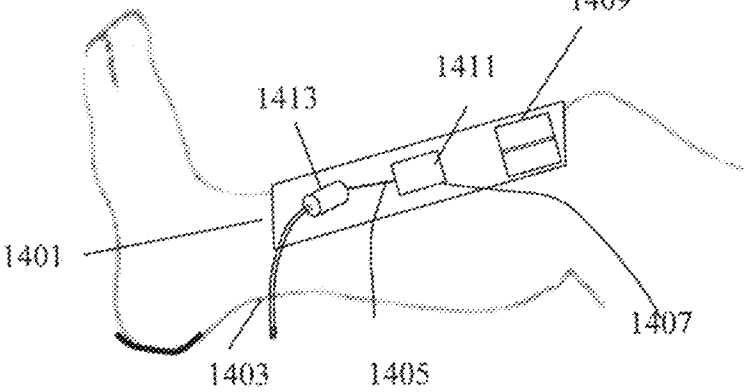
FIG. 14 displays component layout on a shin plate of a leg deep vein massager in an aspect of the present invention.

FIG. 14 displays component layout on a shin or Tibia plate of a leg deep vein massager in an aspect of the present invention.

The Tibia plate 1401 aligned with and pressed against the skin covering the shin bone, supports a power source 1409, battery or wireless rechargeable, an air pump 1413, circuitry with a timer switch 1411. Upon receiving signal from the an air pressure sensor when the air pressure reaches a preset threshold pressure, the air pump 1413 feeding the inflation channel 1403 turns off and the air discharge valve 1405 signal to open. In addition, the timer switch 1411 circuitry provides logic to preset the frequency of the compression-deflation cycles. A contact switch signal 1407 can be used to trigger a start or reset.

Figure 15:
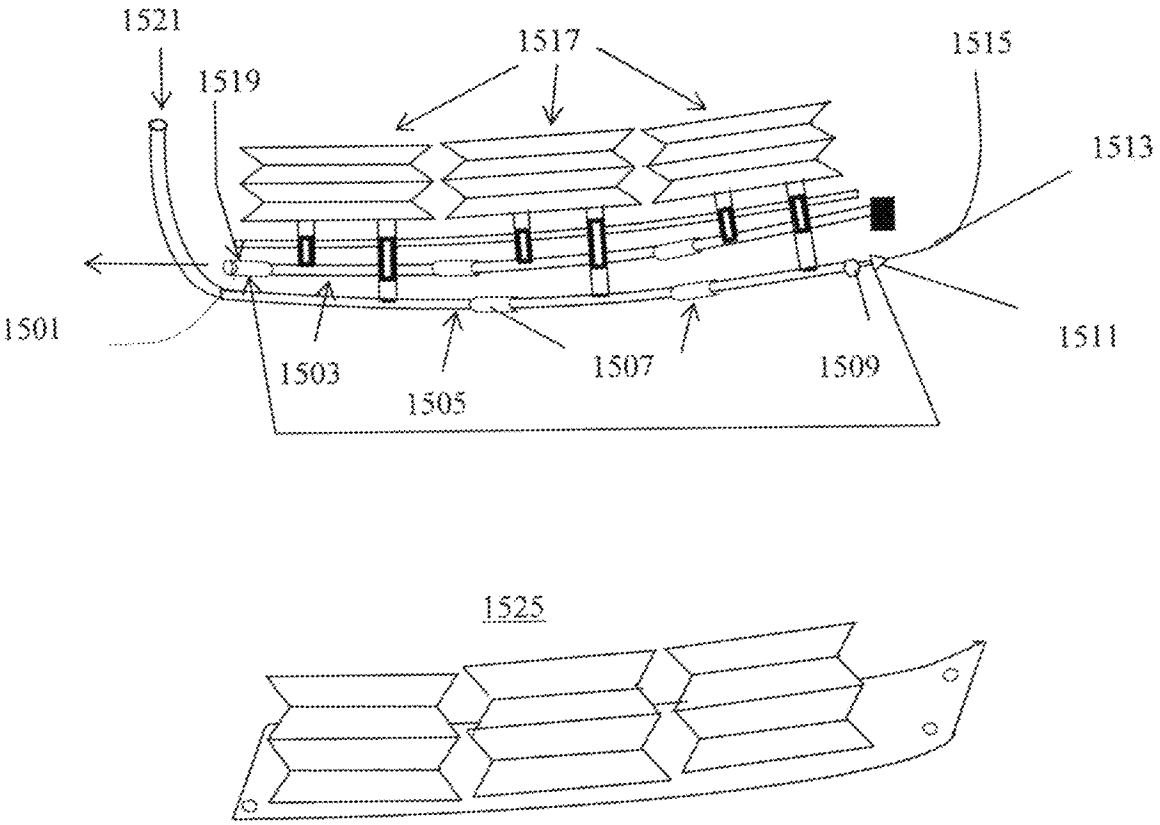
FIG. 15 displays the pneumatics schematic for a leg deep vein massager in an aspect of the present invention.

FIG. 15 display the pneumatics schematic for a leg deep vein massager and propulsor in an aspect of the present invention. Only the bare lateral cartridge is shown in 1525. Other embodiment components including power and signal are provided from a timer switch 1501 1515 which energize and de-energize actuation of the pressure valves 1509 1519 for the inflating 1505 and deflating 1503 pneumatic pressure valve subsystems. Pressure valve and connectors 1507 operate to channel air flow through the inflating tubes when air pressure supply 1521 reaches the high set pressure, 75 mmHg. When the pressure valve 1509 at the end of the inflating tubing receives a pressure equal to the high set pressure, 75 mmHg, it triggers the opening of the valve 1519 to deflate the air bellows. Pressure valves 1503 will direct airflow out when the valve 1519 off to deflate the air bellows. Pressure valves 1503 will allow air flow out, when the air pressure at both ends gets a low pressure set signal, 10 mmHg. Signal from a pressure sensor 1513 communicates with the timer switch 1515 logic which is in communication with a contact switch.

FIG. 16 displays normal and blocked blood flow in deep veins describing an aspect of the present invention. In normal flood conditions 1605 the flow 1603 displays an uncompressed 1601 vein diameter and one-way leaflet valves which are open. In normal blocked flow 1611, flow 1609 is blocked to downstream by virtue of the vein compression 1607 and valve closure to back flow. Thus in "normal" circumstances, an outside compression would tend to push the blood up the leg and toward the heart unidirectional only.

FIG. 17 displays overly distended deep vein blood flow in deep veins describing an aspect of the present invention. In overly distended deep veins 1701 the leaflet valves 1703 or valvules are extended to abnormally large vein diameters, too far apart 1705 to allow the valvule to close tightly upon compression. Leaked backflow 1709 is the result, allowing flow 1707 in the backward as well as forward 1711 directions in the compressed vein 1713 condition. If the leg deep veins become overly distended or if the valvules become irregular or damaged, deep vein massage does not work as effectively. Compression of the deep leg veins to diameters subject to valvule closure ranges is therefore preferred and helpful in massaging the calf in synchronized concert of segmented local non-circumferentially covering regions on the leg calf. Hence the synchronized compression-decompression of the deep-leg veins work to reduce vein distension 1705 to diameters below valvule closure ranges 1709.

Figure 18:
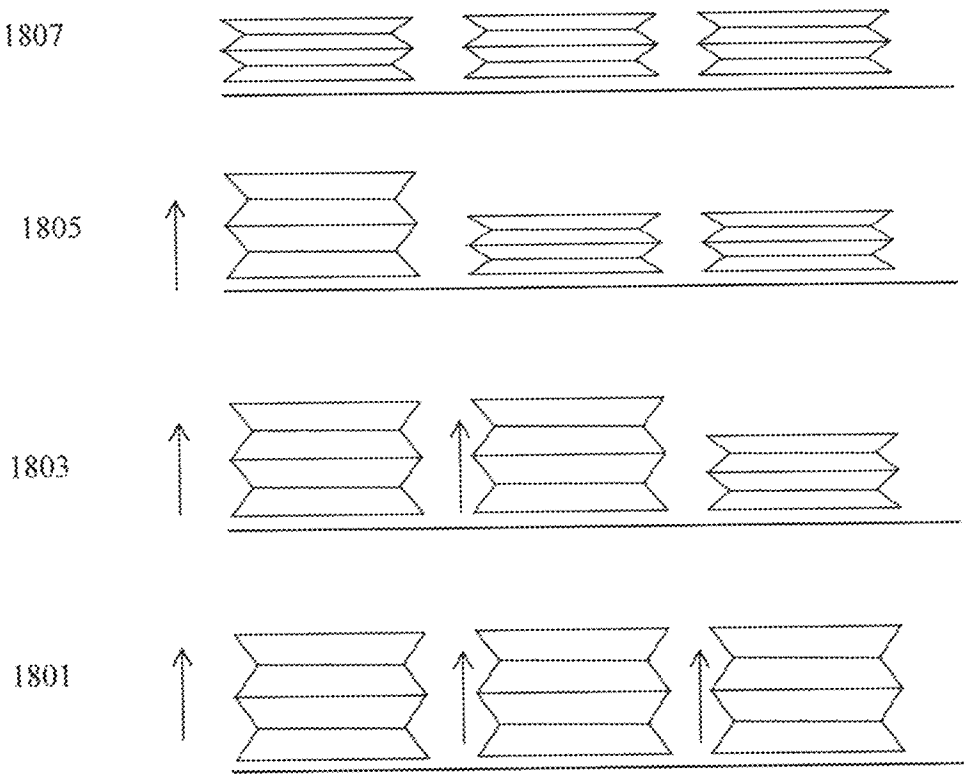
FIG. 18 illustrates a propulsive wave air-bellows compression sequence in an aspect of the present invention.

FIG. 18 illustrates a propulsive wave air-bellows compression sequence in an aspect of the present invention. The object of the synchronization mechanism is to propel the deep vein blood through a series of compressions along the vein length, compressing and decompressing adjacencies in concert along the leg length such that blood is compelled from the compressed to the uncompressed portion and then propagating the compressed zone along the let length, creating a wave like propulsion while pumping deep vein blood toward the heart. This is illustrated by the series of compressions of the bellows 1807 1805 1803 1802 in FIG. 18 respectively.

Figure 19:
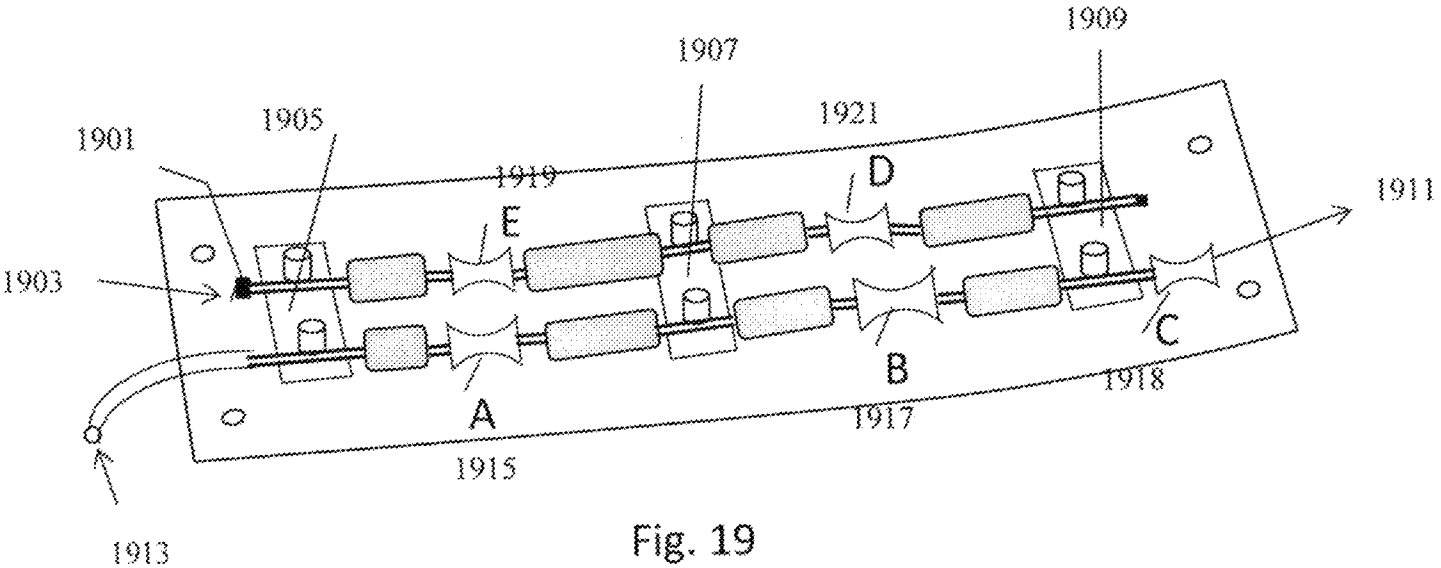
FIG. 19 illustrates a pneumatic tube-air bellows assembly in an aspect of the present invention.

FIG. 19 illustrates a pneumatic tube-air bellows assembly in an aspect of the present invention. Construction of the propulsor cartridge assembly comprises an array of 3 or more air bellows air in/out banks 1905 1907 1909 connected in series by air pressure pumped tubes through a series of preset high pressure limit, 70 mmHg shown, pressure valves following each in/out bellows bank 1905 1907 1909. Air being pumped in 1913 enters the first bellows stage through the connecting tube 1905 and pressurizes the bellows to the limit, compressing the vein in so doing. The air pressure continues down the bellow series to the second bellows entry tube 1907 upon valve A 1915 opening, pressurizing the second bellows. Similarly, upon bellows expansion compressing the vein, pressure valve B 1917 is energized open at the high pressure preset, 70 mmHg, filling the third bellows through connecting tube 1909. In like manner the cycle repeats through the next stage valve 1918. The last air bellow in the series is connected to an air pressure sensor 1911 upon sensing the preset limit is triggered to activate the settable timer switch, to turn off incoming air 1913 and to open the discharge valves D 1921 E 1919 and last 1903 for deflating the bellows and uncompressing the vein, in a preset cycle time, sensed to a time logic 1901 for cycle discharge control.

In compression cycle, the input air pump is initiated and valve open to allow air flow to the air bellows stage 1 followed by air bellows stage 2. The air to stage 2 bellows pressure increases through valve until high pressure pre-set is reached, upon which valve is opened to stage 3 bellows. Air flows to air bellows stage 3 reaching the high pressure pre-set value. Upon reaching pre-set high value an air pressure sensor is activated to turn off input air pump and open discharge valve, triggering a decompression cycle.

Decompression is triggered by air pressure sensor upon reaching pre-set high pressure in stage 3. The discharge valve is opened to release air from air bellows stage 1. As air in bellows stage 1 pressure drops to low pressure pre-set value, valve for stage 2 is opened until depressurized to low pre-set. Achieving a low pre-set pressure then triggers pressure valve air release at stage 3. Air pre-set pressures are adjustable but typical low pre-set pressure valve setting are 10 mmHg and high pressure valve pre-set is 70 mmHg.

Figure 20:
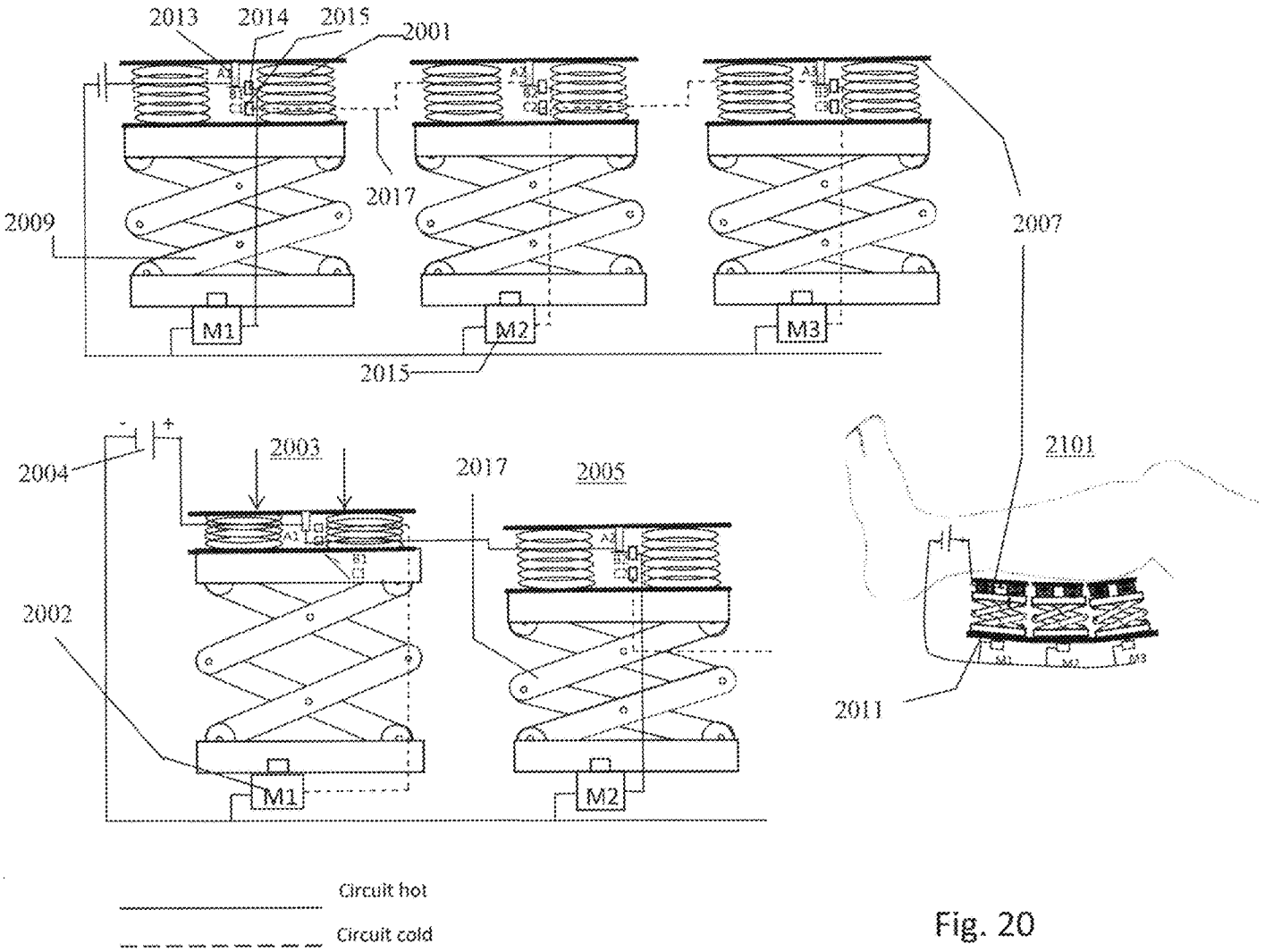
FIG. 20 a schematic illustration of expandable-retractable component assembly for the compression-de-compression sequence in another embodiment of the present invention.

FIG. 20 illustrates an expandable-retractable electro-mechanical assembly for the compression-de-compression sequence in another embodiment of the present invention. A semi-rigid conforming leg surface upper plate 2001 for each stage is supported by expandable-retractable framework 2009 supporting a segmented leg calf surface 2007 conforming used in performing the synchronized propulsive wave of compression-decompression on a leg calf region. The compression wave is synchronize to impart surface pressure 2003 on the first stage, followed by the addition of the second stage 2005 and so forth. Each stage leg surface plate 2007 is pressurized from the trestle-like expandable-collapsible frame work 2009 mechanism supported from an assembly plate floor cartridge 2011.

The controls for synchronizing a segmented leg surface 2007 massager can be digital or analog or a combination. The FIG. 20 and FIG. 21 embodiment illustrate a compression and decompression cycle for a segmented synchronization leg blood propulsor. As the stage 2003 motor 2002 powered 2004 to turn gear which extends the linked framework 2009 towards the segmented plate surface 2007 the segment surface 2007 with coupled spring 2001 contact point A1, which is connected to power 2004 through a circuit 1 switch in contact with spring contact B1 completes the circuit to motor 2002 M1 energizing the motor to turn and extend the linkage framework 2009 toward the segment surface plate 2007. When a pre-set high pressure is reached the spring will be compressed to a high set point contact connecting surface 2007 point A1 2013 with spring contact point C1 2015. This will stop the stage motor 2002 closing the next stage 2005 circuit 2017 to energize the next stage motor 2015. This will then extend the next stage 2005 linkage framework 2017 compressing the spring to stop its motor upon spring compression reaching the C2 contact switch and energizing the next stage circuit with motor M3.

Figure 21:
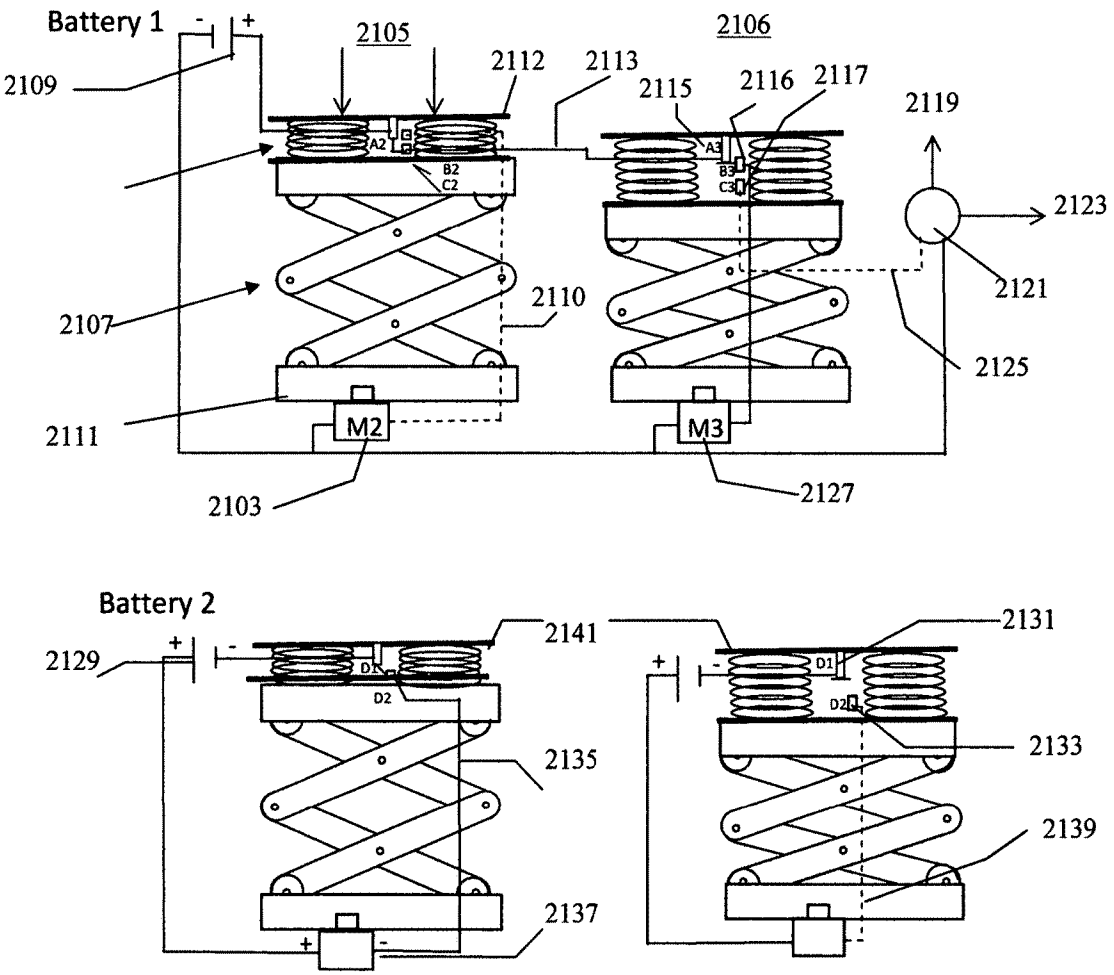
FIG. 21 illustrates an schematic illustration of the expandable-retractable mechanism assembly with motors for each stage of the compression-de-compression sequence in another embodiment of the present invention.

FIG. 21 illustrates an schematic view of an expandable-retractable cross-link 2107 mechanism assembly with motors for the compression-de-compression cycle and sequence in an embodiment of the present invention. The compression-de-compression cycle is synchronized illustrated here using the last two stages, driven by motors M2 2103 at stage n−1 and M3 at last stage n, coupled to an assembly supporting cartridge plate 2111 for the close of the compression cycle. Powered by battery 1 2109 the motor M2 2103 is energized by circuit 1 2110 until the spring working against the segment surface plate 2112 makes switch energizing circuit 2113 to last stage 2106. The internal spring contacts A3 2115 B3 2116 and C3 2117 are analogous to those in FIG. 20 earlier stages with the addition of a circuit 2 2125 to a timer switch 2121. The timer switch is of variable settings for signaling when to engage a second power source, battery 2 2129 for a set time interval. One circuit 2119 is to be opened, de-energizing battery 1 2123 2133 and another circuit closes to engage battery 2 2129 circuit 2135 for the decompression cycle.

The motors are electrically connected to at least two sets of batteries of opposite polarities: one set to rotate the motor clockwise, another set to rotate the motor anti-clockwise. Each stage will engage to compress and decompress a spring stage 2105 pressure impinging on the leg calf. The segment surface 2141 engages a spring switch D2 energizing circuit 2135 to the motor 2137 to reverse turn and contract the linkage framework. This sequence is then cascaded down the stage order.

Figure 22:
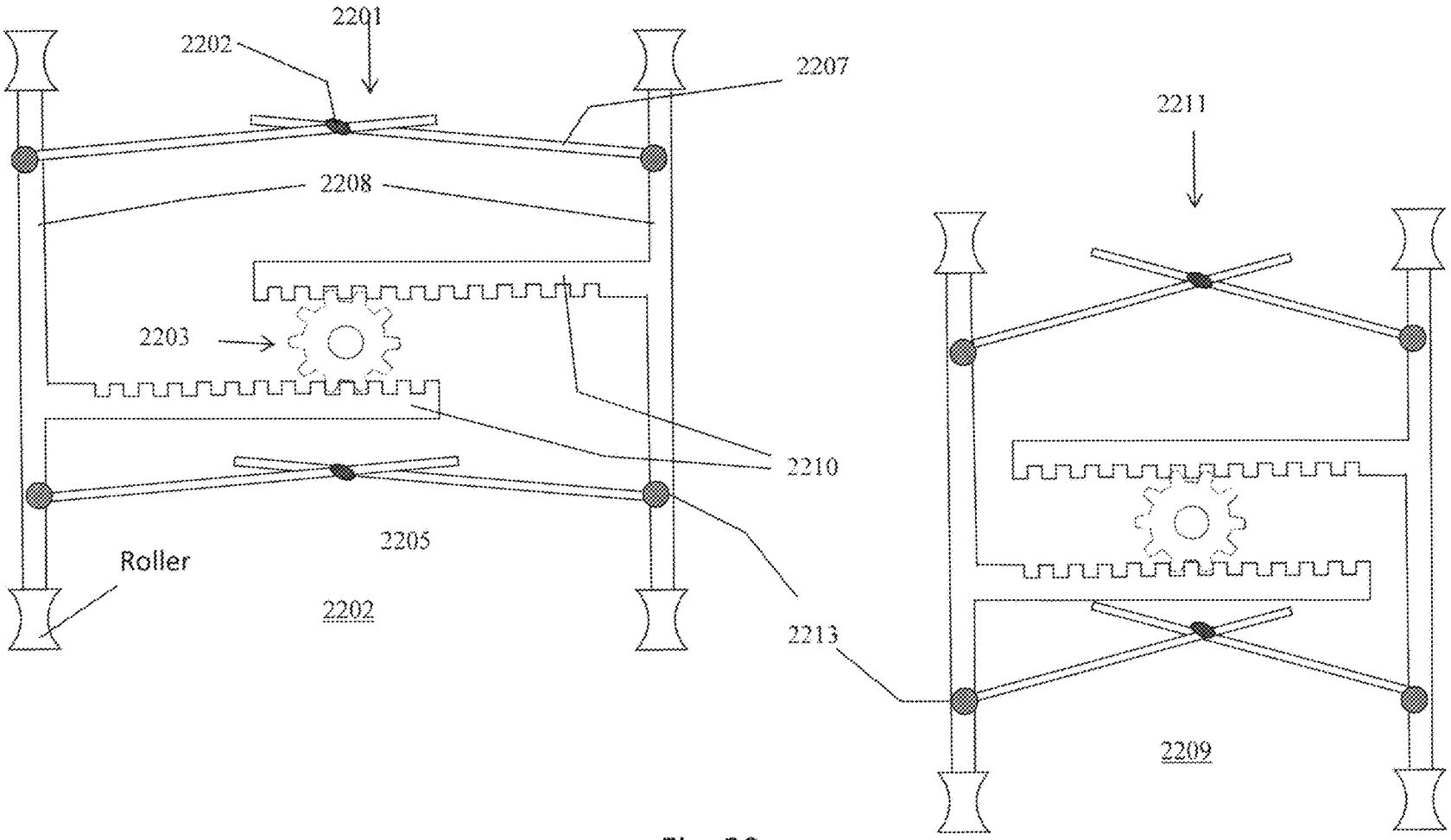
FIG. 22 illustrates an motorized cross-hatch with springs working frame deep vein leg massager in an aspect of the present invention.

FIG. 22 illustrates a motorized cross-link frame mechanism pushing springs for compression-decompression on a leg contact surface deep vein leg massager in an embodiment aspect of the present invention. A motor 2103 drives a pinion gear 2203 coupled to two opposing racks 2210 coupled to a transverse oriented roller bars 2208 having rollers 2205 on each end such that gear 2203 turns translate the roller bars toward or away from each other. Each roller bar 2208 has transverse rotatable linkage arms 2207 engaging a mirror transverse rotatable linkage at a slider 2202 linkage midway 2201 between the roller bars 2208 forming push-pull points at the transverse linkage arm 2207 distal ends. The decompressed 2201 and compression 2211 modes are shown.

Figure 23:
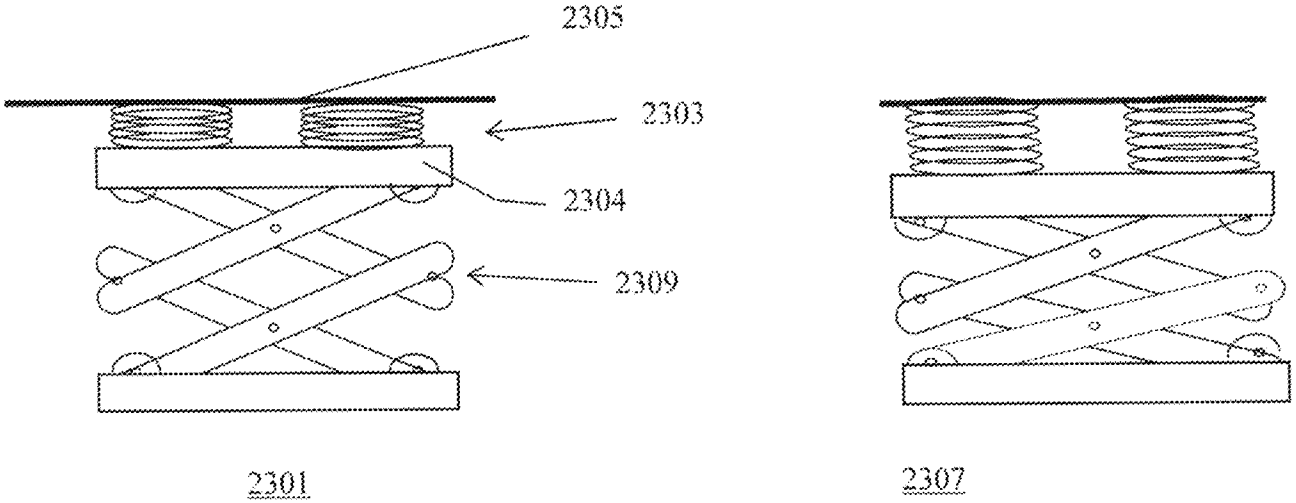
FIG. 23 illustrates an motorized cross-linkage coupled to springs working a semi-rigid surface on a leg for deep vein leg massage in an aspect of the present invention.

FIG. 23 illustrates an motorized cross-linkage coupled to spring switch coupled to a semi-rigid surface for massaging a leg for deep vein leg massage in an embodiment of the present invention. Compressed 2301 and decompressed 2307 springs 2305 switches respectively combine with expanded linkage frame 2309 mechanism or contracted 22307 linkage framework respectively to provide synchronous segmented calf region compression-decompression along the length of the leg calf side opposite the shin side.

The embodiment shown has a rigid surface component 2305 spring 2303 coupled to another rigid plate-like component 2304. The combined spring constant has a characteristic stiffness range inclusive if the pressure default high and low pre-sets which energize and de-energize circuits triggering independent massage surface segment stage motors. In and embodiment of the invention the pre-sets can be at 10 mmHg to 70 mmHg pressure for low to high defaults respectively. As circuits are energize the plate surface component 2305 will apply an increasing pressure until the pressure reaches the high set point, upon which the control contact spring 2303 points will change the operating stage circuits to reverse motor and energize the next stage motor to expand the linkage framework. In an embodiment of the invention this can be done by reversing the motor polarity.

Figure 24:
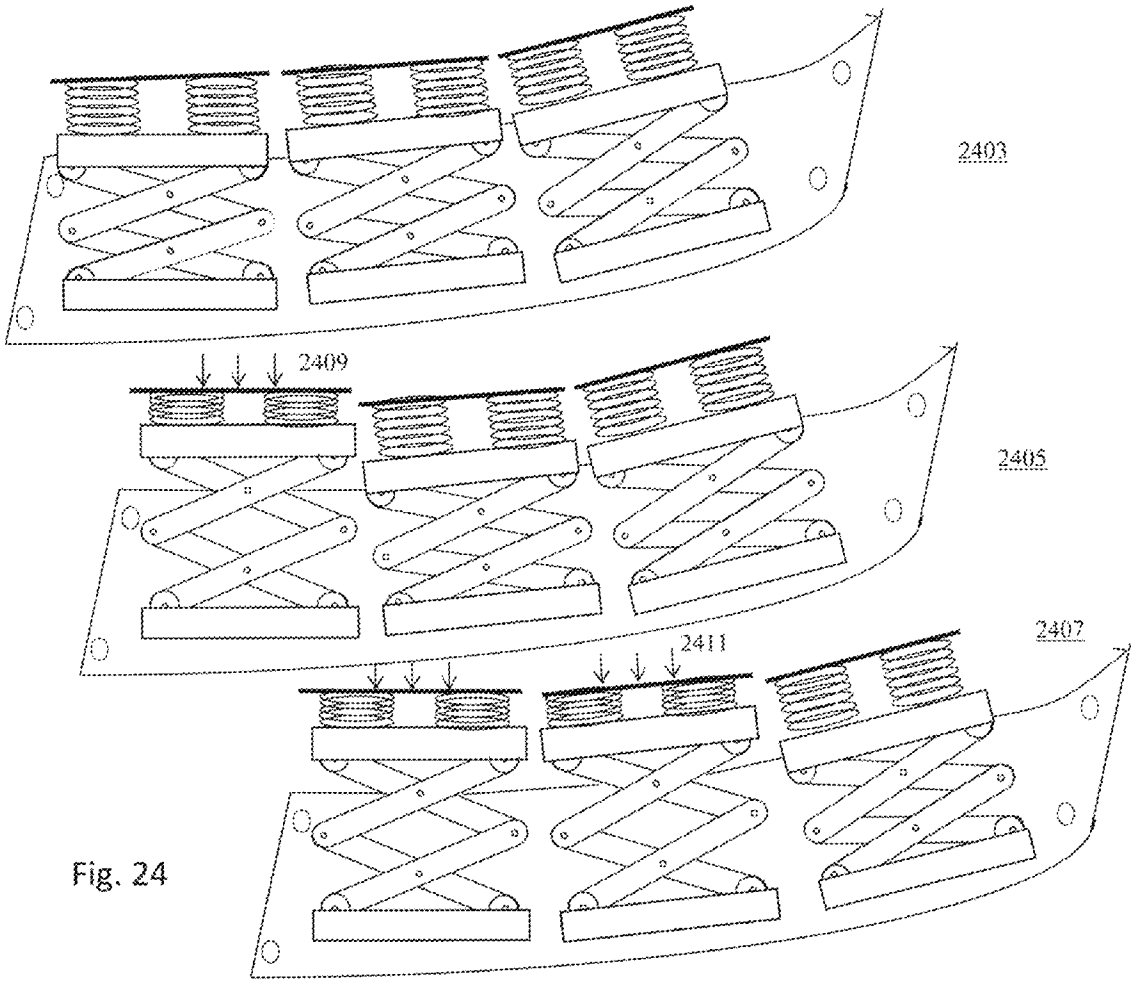
FIG. 24 illustrates an motorized cross-linkage with spring working platform stage sequential compression deep vein leg massager in an aspect of the present invention.

FIG. 24 schematic illustrates an motorized cross-linkage assembly cartridge complete with staged spring working segment surfaces for each stage operating in sequential compression-decompression for leg calf deep vein. The sequence 2403 2405 2407 cycles compression generally form the ankle-side, bottom of the calf 2409 and towards the upper leg knee-side 2411 to the final stage upper nearest the knee calf position providing a smooth propulsive massage in a synchronized but force directed wave from the outside calf back-of-leg position starting from the just above the ankle and ending below the knee. Each mechanical assembly stage mechanical mechanism assembly applies a compressive force 2409 2411 decompressive force over a calf local or segmented area.

An embodiment of the portable deep vein leg massager and propulsor apparatus has two or more independent mechanical mechanism assembly stages each stage providing a compressing-decompressing surface plate component along a leg local calf area directly opposite the shin. Each calf surface plate has a spring switch operatively connected upon spring extension-distension contacts for opening and closing two circuits, and also mechanically coupled to an expandable-retractable linkage framework assembly. Each linkage framework assembly base comes with a motor whose axial pinion gear rotating clockwise or counter clockwise translates opposing racks to move toward or away from the motor center respectively, causing crossed linkages to extend or contract the linkage framework. Finally the motor operating in two separate circuits, circuit 1 to engage rotation and circuit 2 to change motor rotation direction and open circuit 1 on the next stage linkage framework assembly. Thus all the stage surface segments are synchronized to impart surface pressure on the first stage, followed by the addition of the second stage and so forth, each stage leg surface plate is pressurized from the expandable-collapsible linkage framework mechanism supported from an assembly plate base cartridge and then depressurized in a synchronized fashion to repeat the segmented surface massage cycle.

Figure 25:
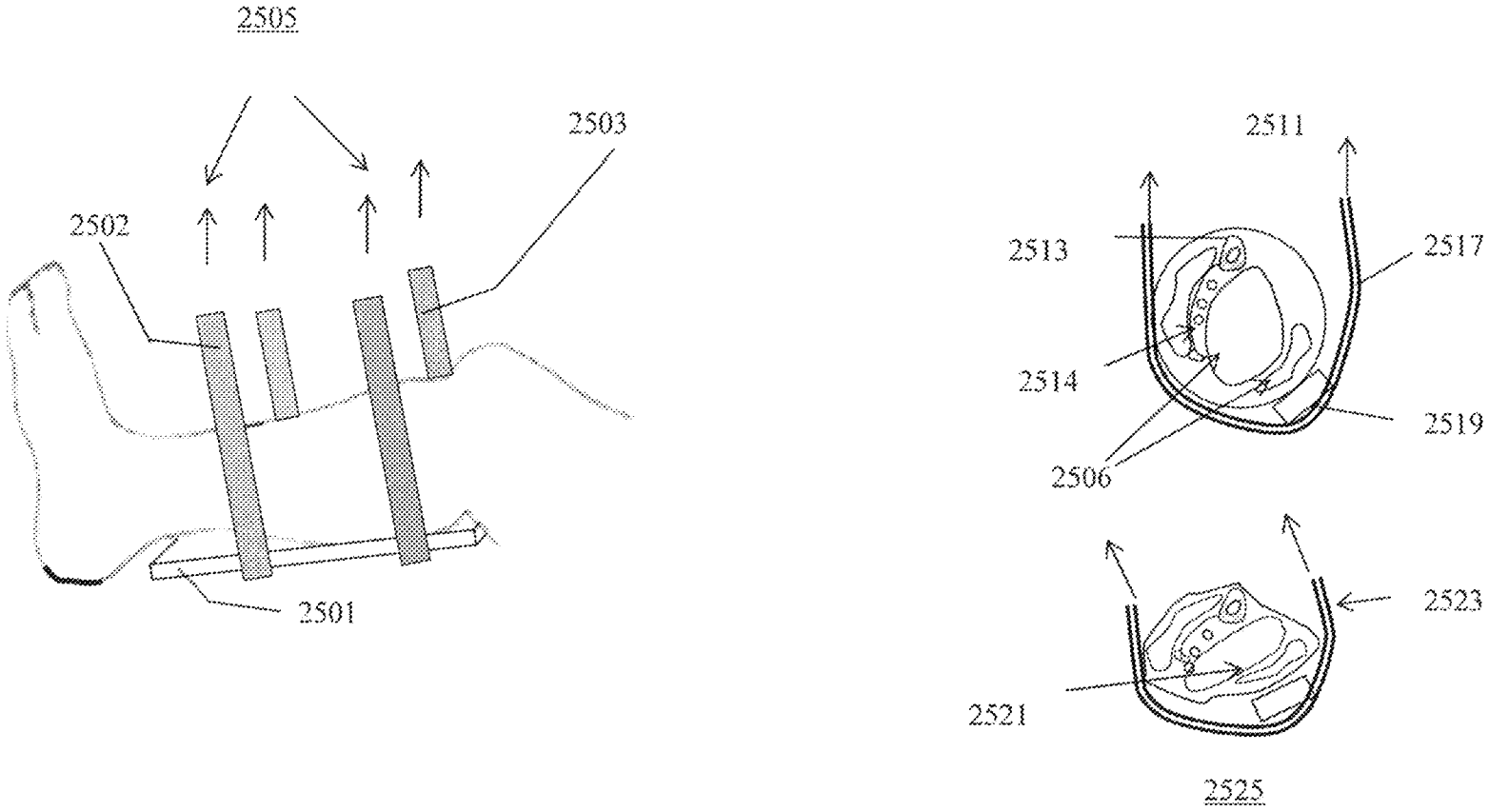
FIG. 25 illustrates a one-plane-tightening-loosening-cycle-band platform deep vein leg massager in an aspect of the present invention.

FIG. 25 illustrates a one-plane-tightening-loosening-cycle-band platform 2505 deep vein leg massager in an aspect of the present invention. A semi-rigid or rigid plate 2501 is coupled to a lower 2502 leg, ankle-side and upper 2503 leg, knee-side, calf massager compression plate-like component which is used to apply pressure along the length of the leg calf one side of the leg. The compression plate 2501 component can be rigid or semi-rigid and coupled by strap or belt 2507 2523 to a shin plate component used apply pressure to the plate 2501 2519 2525 in such a manner as to load the calf muscle region 2506 along the length of the calf and opposite the Tibia 2513 or shinbone side such that the muscle is in more or less flat plate contact compressed 2525 from one side only and is caused to transfer plate pressure to squeeze and conform flatly against first the muscles 2506 2521 and then the leg deep veins 2514 as well as the muscles 2506 2521. The pressure brought is direct and does not then work against itself from lateral sides or circumferentially placed forces and pressures that would compress the muscles from lateral directions tightening the muscles for more resistance to the calf directed segmented forces.

Figure 26:
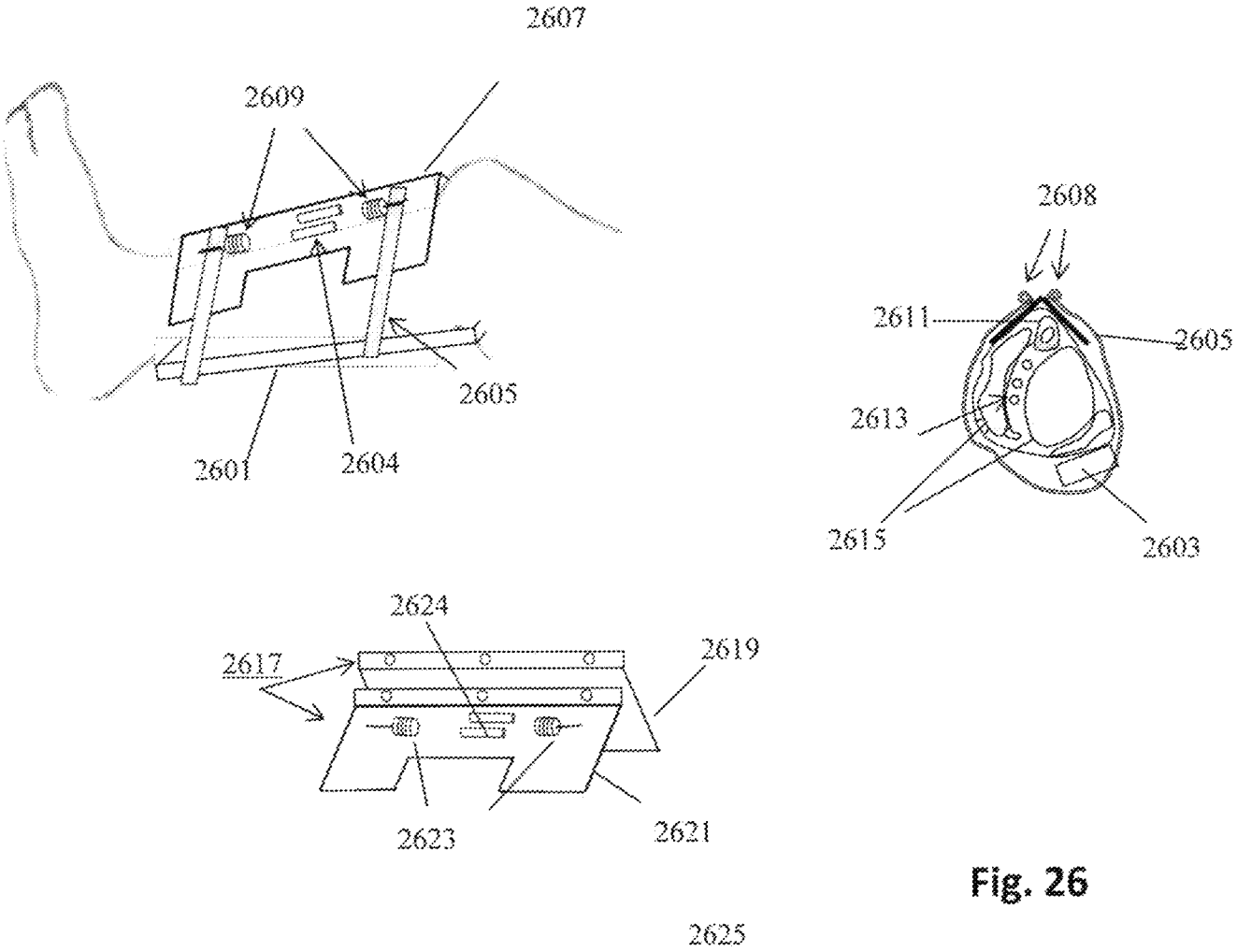
FIG. 26 illustrates an motorized-Tibia-plate pulling-band-coupled-compression-plate platform deep vein leg massager and propulsor in an aspect of the present invention.

FIG. 26 illustrates an motorized-shin-plate pulling-band-coupled-compression-plate platform deep vein leg massager in an aspect of the present invention. The compression plate 2501 2601 component is stabilized by the Tibia or shin bone 2611 plate 2607 by virtue of coupling to the compression plate 2601 through straps, belts or bands 2605. The Tibia plate 2607 has a bend so that it straddles the Tibia bone 2611 along the leg longitudinal axis. Several motors 2608 2609 attached to the Tibia plate 2607 are coupled to the two straps 2605 at both ends of the plates 2601 2607 such that motors can tighten and loosen the strap 2605 tension upon demand. Batteries 2604 attached to the Tibia plate 2607 power the motors upon demand with manual switches or wirelessly. Tensioning the straps 2605 will compress the calf compression plate 2603 component against the calf muscle 2615 acting to flatten the muscles, which will move to compress the leg deep veins 2613 simultaneously. A sensor is mounted on the compression plate 2601 so that a pre-set high pressure will trigger a timer switch circuit to energize and de-energize the motors, providing a cycle compression-de-compression on the calf muscle 2615 The plates can be made of rigid and semi-rigid materials such as thin light-weight metal, wood, plastic, composite, hard rubber, etc.

The Tibia or shin plate 2607 is made with a bend around the shin bone 2611 along the leg axis. This plate 2617 can also be two plates 2617 coupled to form a "V" bend 2619 2621 covering the shin. Motors 2623 and batteries 2624 can be mounted on either side of the plate and the motors 2623 are coupled to the straps to the compression plate.

Figure 27:
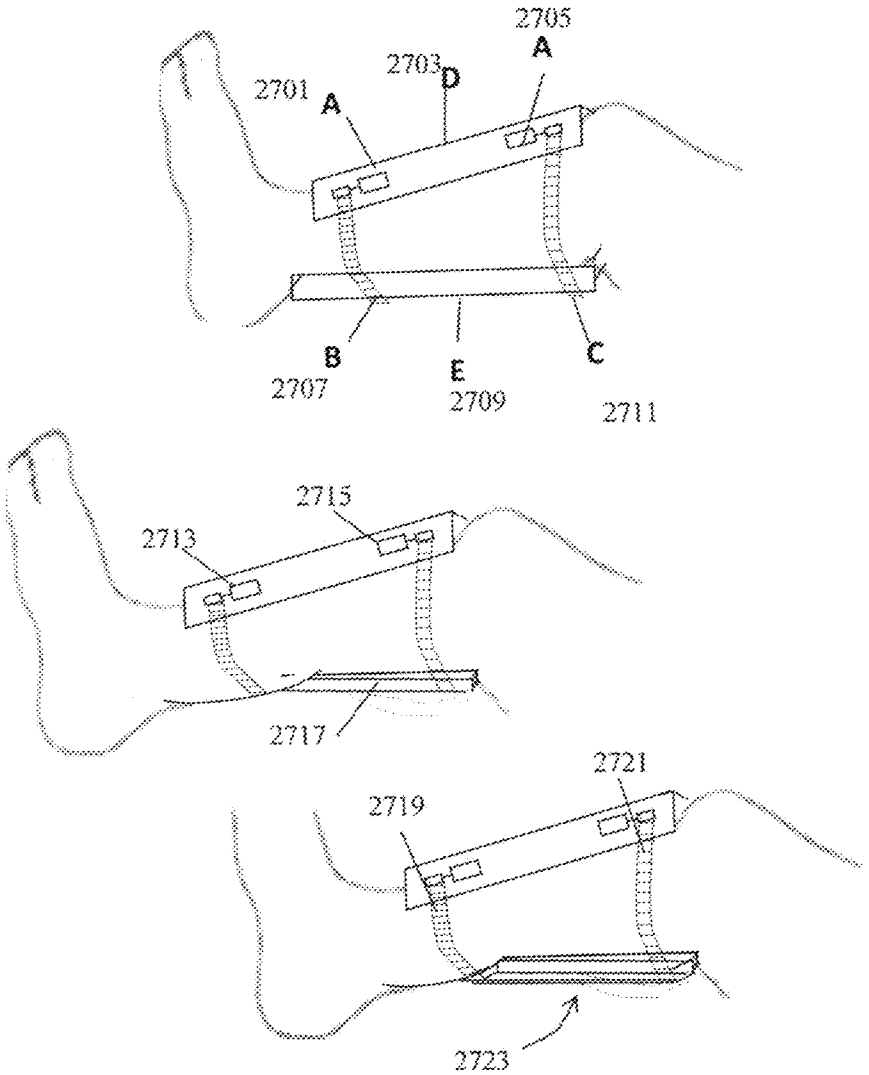
FIG. 27 illustrates a one stage motorized-Tibia-calf-band-coupled synchronized platform deep vein leg massager in an aspect of the present invention.

FIG. 27 illustrates a one stage pivoting shin-calf-band-coupled platform deep vein leg massager embodiment. A one stage embodiment has a bent surface rigid or semi-rigid shin plate positioned adjacent and straddling the tibia or shin bone 2703. A least two straps, lower 2707, ankle-side, and upper 2711, knee-side are operatively coupled with motors 2701 and 2705 respectively which are themselves secured to the shin plate 2707 for cycling compression and decompression on the calf. The straps are coupled to the calf compression plate 2709. The motors 2713 2715 affixed to the shin plate 2703 firmly tighten their corresponding straps for the compression-decompression cycle. The lower strap 2719 is locked tight at the low set tension and the upper strap 2721 is slowly tightened by motor 2715 action from a low default setting tension to a high preset tension setting. A timing circuit controlling the motor action has an adjustable timer and pressure presets to control the massage cycle and strap tightness. Wherein two coupling shin-plate to compression plate straps are tightened and loosened by local motor power synchronized with calf deep vein flow to compel blood from the lower calf region, ankle-side, to the upper leg region, knee-side, through only a cyclical differential tightening and loosening of the upper leg situated strap 2719 1721 or belt acting to displace the calf surface evenly and continually through the compression and decompression linearly along the calf axis pivoting from the bottom strap 2719 through the massager compression plate motion 2723 coupled to the tightening and loosening of the straps or belts supporting the compression plate 2717 ends to the leg calf.

Therefore, while the invention has been described with respect to a limited number of embodiments, those skilled in the art, having benefit of this invention, will appreciate that other embodiments can be devised which do not depart from the scope of the invention as disclosed herein. Other aspects of the invention will be apparent from the following description and the appended claims.

What is claimed is:

1. A portable deep vein leg massager and propulsor apparatus coupled to a harness adapted to be attached to a human leg, for pressure application along only a segment of a leg circumference, the portable deep vein leg massager and propulsor apparatus comprising:

a base holder plate housing an inner cartridge fitted for supporting independent compression-decompression mechanical assemblies in segmented stages, the base holder plate coupled to harness straps and adapted to be positioned by the harness to the leg calf opposite the shin bone;

two or more independent mechanical assembly stages, each stage comprising a mechanical mechanism for applying a compressing-decompressing force to a calf conforming surface area, said stages comprising calf surface area plate-like segments pushed and pulled by each mechanical mechanism supported by an inner cartridge plate;

wherein the harness straps comprise at least two harness straps coupling a plate-like component adapted to be positioned on a shin bone and adapted to straddle the tibia opposite the base holder plate adapted to be attached to a calf;

at least one battery affixed to the plate-like component for powering the mechanical mechanism to compress and decompress the calf surface area plate-like segments;

a variable settable timer switch electrically coupled to battery power for energizing and de-energizing the mechanical mechanism compressing and decompressing the mechanical assembly stages, and electrical controls for compressing and decompressing the mechanical assembly stages for cycling up and down the leg calf in concert to compel deep vein blood toward the heart, whereby compression-decompression of a calf surface area plate-like segment adapted to be performed on a local non-circumferential region of the calf is controlled in synchronized concert with an adjacent calf surface area plate-like segment by energizing and de-energizing power to the mechanical mechanism serially to provide leg deep vein massaged through a minimum of portable energy supplied for propulsing deep vein blood flow and massaging.

2. A portable deep vein leg massager and propulsor apparatus of claim 1, further comprising:

an air pump for pumping pneumatic pressure to the mechanical assembly stages, wherein the mechanical assembly stages comprise bellows, and the air pump is connected to the bellows via pneumatic channels and pressure control valves which are actuated to inflate and deflate the bellows in accordance with a preset synchronous cycle;

a timer switch electronically connected to each mechanical mechanism via circuitry, the timer switch being responsive to a signal from an air pressure sensor having a preset threshold pressure; and a contact switch;

wherein, control of the air pump to feed the pneumatic channels is responsive to a signal from the air pressure sensor indicating that the air pressure has reached the preset threshold;

wherein, the circuitry of the timer switch provides logic to preset the frequency of the compression-deflation cycles; and wherein, the contact switch is used to trigger a start of rest of the compression-deflation cycles.

3. A portable deep vein leg massager and propulsor apparatus of claim 1 further comprising:

the two or more independent mechanical mechanism assembly stages with each stage providing a compressing-decompressing surface plate component adapted to be along a local calf area directly opposite the shin, at least one calf surface plate having a spring switch operatively connected upon spring extension-distension contacts for opening and closing two circuits, and also mechanically coupled to an expandable-retractable linkage framework assembly, at least one linkage framework assembly base with a motor coupled to an axial pinion gear rotating clockwise or counter clockwise for translating opposing racks to move toward or away from the motor center respectively, causing crossed linkages to extend or contract a connected linkage framework, and the motor operating in two separate circuits, circuit 1 to engage rotation and circuit 2 to change motor rotation direction and open circuit 1 on a valve of a next mechanical assembly stage, whereby stage surface segments are synchronized to impart surface pressure on a first stage, followed by the addition of a second stage and so forth, each stage surface plate is pressurized from an expandable-collapsible linkage framework mechanism supported from an assembly plate base cartridge and then depressurized in a synchronized fashion to repeat the segmented surface massage cycle.

4. A portable deep vein leg massager and propulsor apparatus of claim 1, wherein the synchronized compression-decompression of the deep leg veins reduces vein distension to diameters below valvule closure ranges.

5. A portable deep vein leg massager and propulsor apparatus of claim 1, wherein, the mechanical mechanism in each mechanical assembly stage further comprises a mechanical pump affixed to the plate-like component for pneumatic expansion and contraction of bellows at each stage.

6. A portable deep vein leg massager and propulsor apparatus of claim 1, wherein massager segment plate surfaces are adapted to be positioned over calf adjacent local non-circumferential regions opposite the shin.

7. A portable deep vein leg massager and propulsor apparatus of claim 1, wherein the harness straps comprise two anchor straps comprising an ankle side strap and a knee-side straps which are tightened and loosened by local motor power synchronized with calf deep vein flow to compel blood from the ankle side calf region to the upper leg region through a cyclical differential tightening and loosening of the knee-side situated strap acting to displace the calf surface evenly and continually through the compression and decompression upward linearly along the calf axis through motion of the base holder plate caused by the tightening and loosening of the straps supporting base holder plate ends to the leg calf.

8. A portable one-stage shin-adapted, band-coupled pivoting platform deep vein leg-adapted massager apparatus and attached harness, the apparatus comprising:

a compression plate having a substantially flat surface, the compression plate adapted to conform to a calf; a shin plate bent along a longitudinal axis and adapted to straddle the shin bone to be positioned adjacent and along the tibia, at least two straps, comprising a lower ankle-side strap and an upper knee-side strap coupling the shin plate opposite to the compression plate and pivoting about an ankle side compression plate edge, the upper and the lower ankle-side strap respectively coupled to the shin plate for cycling compression and decompression on the calf from ankle-side to knee-side longitudinally along the leg axis, at least two motors synchronized to cycle by tightening corresponding straps of the at least two straps for a compression-decompression cycle beginning at the lower strap compression plate edge and ending at the upper strap compression plate edge from a low default setting tension to a high preset tension setting, a timing circuit controlling a motor tension cycle with an adjustable timer and pressure presets to control massage cycle and alternating strap tightness, whereby, in use, two of the at least two straps are tightened and loosened by motor power synchronized with calf deep vein flow to compel blood from the lower calf region, ankle-side, to the upper leg region, knee-side, through only a cyclical differential tightening and loosening of the upper strap acting to displace the calf surface evenly and continually through the compression and decompression linearly along the calf axis through motion of the compression plate caused by the tightening and loosening of the upper strap by a mechanical assembly coupling the compression plate ends to the leg calf.

* * * * *